US008834236B2

(12) United States Patent
Eklund

(10) Patent No.: US 8,834,236 B2
(45) Date of Patent: Sep. 16, 2014

(54) GRINDING WHEEL

(76) Inventor: Tore Eklund, Motala (SE)

( * ) Notice: Subject to any disclaimer, the term of this patent is extended or adjusted under 35 U.S.C. 154(b) by 588 days.

(21) Appl. No.: 13/254,033

(22) PCT Filed: Feb. 2, 2010

(86) PCT No.: PCT/SE2010/050115
§ 371 (c)(1),
(2), (4) Date: Aug. 31, 2011

(87) PCT Pub. No.: WO2010/101507
PCT Pub. Date: Sep. 10, 2010

(65) Prior Publication Data
US 2011/0319001 A1 Dec. 29, 2011

(30) Foreign Application Priority Data
Mar. 5, 2009 (SE) ..... 0950126

(51) Int. Cl.
*B24B 3/60* (2006.01)
*B24B 3/36* (2006.01)
*B24B 3/54* (2006.01)

(52) U.S. Cl.
CPC .... *B24B 3/36* (2013.01); *B24B 3/54* (2013.01)
USPC ..... 451/541; 451/192; 451/547

(58) Field of Classification Search
CPC ..... B24B 3/368; B24B 3/48; B24D 7/18; B24D 5/123; B24D 5/12; B24D 15/08; B24D 3/54; B24D 15/082
USPC ..... 451/541–547, 552, 555, 192
See application file for complete search history.

(56) References Cited

U.S. PATENT DOCUMENTS

| | | | | |
|---|---|---|---|---|
| 989,692 | A * | 4/1911 | Weber | 76/87 |
| 1,335,603 | A * | 3/1920 | Roberts | 76/87 |
| 4,025,319 | A * | 5/1977 | Smith | 451/545 |
| 4,672,778 | A * | 6/1987 | Rieser | 451/486 |
| 5,655,959 | A * | 8/1997 | Juranitch | 451/486 |
| 6,290,582 | B1 | 9/2001 | Eklund | |
| 7,198,558 | B2 * | 4/2007 | Levsen | 451/263 |
| 2006/0211345 | A1 | 9/2006 | Levsen | |

FOREIGN PATENT DOCUMENTS

WO WO 2004030861 A1 * 4/2004 ..... B24B 3/54

OTHER PUBLICATIONS

International Search Report dated Mar. 18, 2010, corresponding to the PCT application.

* cited by examiner

*Primary Examiner* — George Nguyen
(74) *Attorney, Agent, or Firm* — Young & Thompson

(57) ABSTRACT

A grinding wheel for treatment of a cutting edge, the grinding wheel arranged mountable on a rotatable shaft to be brought in rotation by the driven rotation of the shaft, and including two grinding discs (1≥2) opposing each other and arranged movable relative to each other in the shaft's longitudinal direction and pre-tensioned away from one another, each of the grinding discs having a hub section with fingers protruding freely from the hub section at a radial and an axial component of direction, wherein the fingers are arranged at intervals dimensioned for passage of the corresponding fingers of the opposite grinding disc such that the finger's axial components of direction together form an outwardly open, in an axial cross-sectional plane generally V-shaped notch (V) defined by the intersecting rotational planes of the crosswise running fingers, and in which the fingers each has an area for treatment of the knife's edge.

13 Claims, 3 Drawing Sheets

GRINDING WHEEL

TECHNICAL FIELD OF THE INVENTION

This invention relates to a grinding wheel for treatment of a cutting edge, such as a knife's edge, the grinding wheel arranged mountable on a rotatable shaft to be brought in rotation by a driven rotation of the shaft, and comprising two grinding discs opposing each other and arranged movable relative to each other in the shaft's longitudinal direction and pre-tensioned away from one another, each of the grinding discs having a hub section with fingers protruding freely from the hub section at a radial and an axial component of direction, wherein the fingers are arranged at intervals dimensioned for passage of the corresponding fingers of the opposite grinding disc such that the finger's axial components of direction form an outwardly open, in an axial cross-sectional plane generally V-shaped notch defined by the intersecting rotational planes of the crosswise running fingers, and in which the fingers has an area for treatment of the knife's edge.

BACKGROUND OF THE INVENTION AND PRIOR ART

A grinding wheel having two each other opposing and away from each other pre-tensioned grinding discs arranged on a shaft with crosswise arranged free protruding fingers is previously known from U.S. Pat. No. 989,692. This grinding wheel is not intended to be brought into a driven rotation, as is the grinding wheel of the present invention, and requires a manual forth and back movement of the blade of a knife in the notch that is formed between the stationary arranged fingers. A disadvantage of this grinding wheel is the limited use of the abrasive surface of the grinding disc, which results from that only a narrow peripheral region is active for treatment of the edge. Another disadvantage is the risk that an edge having a sharp, unprotected corner getting caught by the grinding wheel upon insertion of the edge into the grinding wheel. This disadvantage can be seen as less important in connection with the stationary grinding wheel of U.S. Pat. No. 989.692, but is of great importance in connection with a grinding wheel which is driven to rotate at speeds of around 3000 rpm. Another disadvantage with this prior-art grinding wheel is that the treated edge, as viewed in a cross-section, is formed with a thin edge with concave-shaped sides, whereby the edge becomes thin and fragile and sensitive to deformation and wear. Furthermore, the efficiency of this grinding wheel is suffering from the fact that the operator needs to turn the grinding wheel into a non-used area before the grinding takes place.

SUMMARY OF THE INVENTION

The invention aims at providing a grinding wheel of the initially mentioned type, in which the active surface for treatment of an edge or equivalent is maximized.

Another object of the present invention is to provide a grinding wheel designed to eliminate the risk of hooking into the grinding wheel upon insertion of an edge having an exposed and sharp corner.

Still another object of the invention is to provide a grinding wheel in which the treated edge, as viewed in a cross-section, is formed with a tip having convex-shaped sides.

Yet another object of the invention is to provide a grinding wheel comprising abrasive discs which are suitable for manufacture by plastic deformation of a single metal workpiece.

According to the invention, one or more of these objectives are met in a grinding wheel having the characterizing features of claim 1. Preferred embodiments are defined in the subordinate claims.

Briefly there is disclosed a grinding wheel of the initially mentioned type, which is characterized in that the grinding disc's fingers, as well as the intervals between the fingers, from the hub section towards the periphery of the grinding disc, has increasing width between a leading edge and a trailing edge of the finger as viewed in the direction of rotation, and in that the V-shaped notch in an axial cross section comprises an insertion region in which the notch width is wider at the finger's leading edge than the corresponding width at the trailing edge of the finger, when measured at equal radial distances from the grinding wheel centre, whereas the width of the notch radially inside said insertion region is the same at the leading and trailing edges of the finger.

The grinding wheel preferably comprises grinding discs in which the fingers, in the longitudinal direction of the finger, are formed with a concave surface in the plane of rotation.

Preferably, the concave surface of the finger turns into a convex curvature of the finger tip. The connection between the concave surface and the curved, convex finger-tip is located at a shorter radial distance from the grinding disc centre at the fingers leading edge than at its trailing edge, with respect to the direction of rotation. The transition between the concave surface and the finger tip preferably includes a radius in such a way that the curved, convex finger tip has a first radius at the connection to the fingers leading edge, which first radius is greater than a second radius at the connection of the finger tip to the trailing edge of the finger.

A grinding disc according to the above mentioned embodiment is preferably produced by shaping a single metal workpiece. The workpiece can be punched out or cut out from a flat plate to the shape of a star, which is given its final shape in a plastic deformation process, advantageously in a deep-drawing procedure. During the shaping process, the grinding disc's fingers may be given a longitudinal reinforcement in at least one of the finger's edges. This reinforcement can take the form of a flange that extends out of the grinding disc's plane of rotation.

Preferably, the concave surface of the grinding disc's finger is double-curved as a result of giving the grinding disc a conical basic shape at manufacture, wherein the finger in addition to the concave shape in the length direction of the finger also has a convex curvature lying on the cone's mantle surface, as seen in the direction of rotation.

Each finger of the grinding disc has an abrasive or polishing surface structure or coating on the surface that defines the plane of rotation. Appropriate materials and coatings for different applications can be applied in procedures which are known per se, suitable for coating with diamond, ceramic material, hard metal or other hard abrasive, e.g.

The grinding discs of the grinding wheel are pre-tensioned away from each other in the axial direction by means of a spring which is inserted between the two, such that the ends of the spring are received in hub formed for this purpose in each of the grinding discs. This hub can be molded on the grinding disc, or formed integrally with the same.

BRIEF DESCRIPTION OF THE DRAWINGS

The invention is explained more closely below with reference made to the appended drawings, in which an embodiment of the grinding wheel is shown schematically. In the drawings.

DETAILED DESCRIPTION OF A PREFERRED EMBODIMENT

Figure 1:
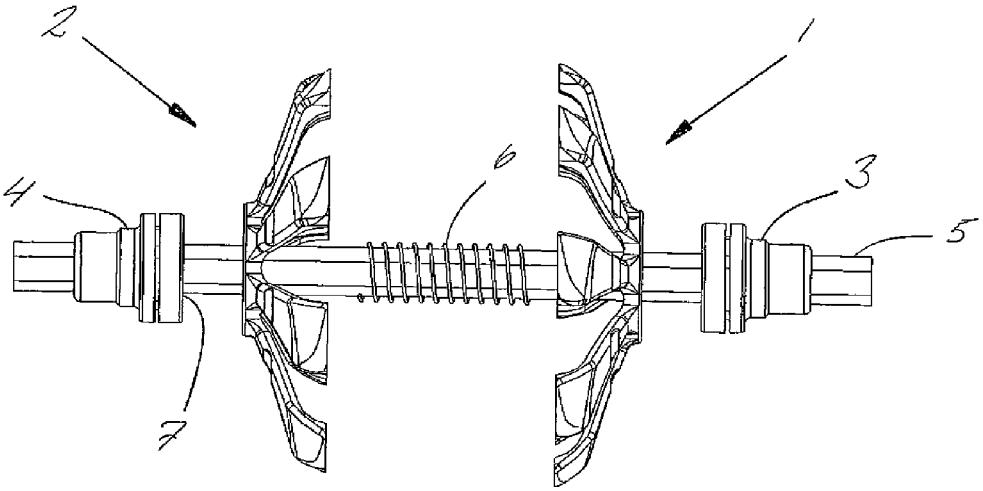
FIG. 1 is an exploded view of the basic elements of the grinding wheel.

A grinding wheel according to the invention comprises the basic elements shown in FIG. 1, including a right and left hand grinding disc 1 and 2, respectively. The grinding discs 1 and 2 each has a hub 3 and 4, respectively, by means of which the grinding discs are non-rotatably mountable on a shaft 5 which is driven in rotation for bringing the discs in rotation with the shaft. Between the grinding discs 1, 2 is a spring element 6 mountable and effective for pre-tensioning of the grinding discs 1, 2 away from each other in the direction of the shaft. The spring element 6, preferably in the form of a coil spring, is preferably received in seats 7 arranged for this purpose in the hubs of the grinding discs. The grinding discs 1, 2 are not symmetrically shaped and thus not interchangeable, as will be explained more closely below. It should be added that the separate hubs 3, 4 of the illustrated embodiment can alternatively be formed as integrated in the grinding discs 1, 2, and in either case the hub preferably has a cornered hole for passage of a cornered shaft and a non-rotational connection between the shaft and the grinding disc.

Figure 2:
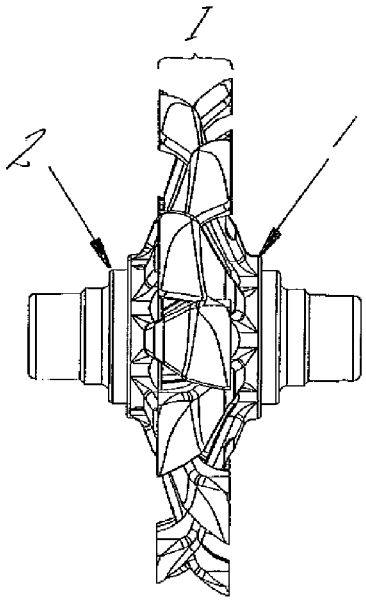
FIG. 2 is a side view of the assembled grinding wheel in a non-operative position.
Figure 3:
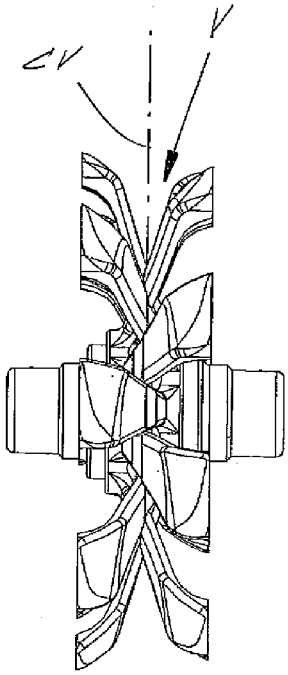
FIG. 3 shows the grinding wheel in FIG. 2 in an operative working position.

Referring now to FIGS. 2 and 3, showing the grinding wheel in a mounted position however without the shaft passing through which is no part of the invention. More specifically, FIG. 2 shows the grinding wheel in a non-operative position wherein the grinding discs 1, 2 are separated in the axial direction through the action of the spring element 6 inserted between them. FIG. 3 shows the grinding wheel in a working position wherein the grinding discs are brought together axially against the force of the spring element. The grinding discs are brought towards the working position shown in FIG. 3 through the contact with an edge or equivalent which is inserted between the grinding discs to be treated by the grinding wheel. The edge is introduced substantially with a tangential orientation relative to the grinding wheel, in the generally V-shaped groove V running about the grinding wheel and defined by the rotational plane formed by the mutually opposite grinding discs in rotation. More specifically, the edge is introduced in radial direction towards an insertion region I in the V-formed notch V, the insertion region which is exposed to the edge also in the non-operative position of the grinding wheel as illustrated in FIG. 2.

An advantageous and preferred feature of the grinding wheel according to the invention is that the surface which is available for treatment of the edge can be utilized to a maximum. Against the force of the spring element 6 acting between the grinding discs 1, 2, the notch V opens to a depth corresponding to the radial insertion depth of the edge, and corresponding to the radially directed force applied from the edge. The force required is determined by the strength and characteristics of the spring element, and can for each specific application be determined by a person skilled in the art. By appropriate choice of the spring characteristics, a substantially constant resistance towards insertion of the edge can be attained, independent of the radial insertion depth of the edge.

Figure 4:
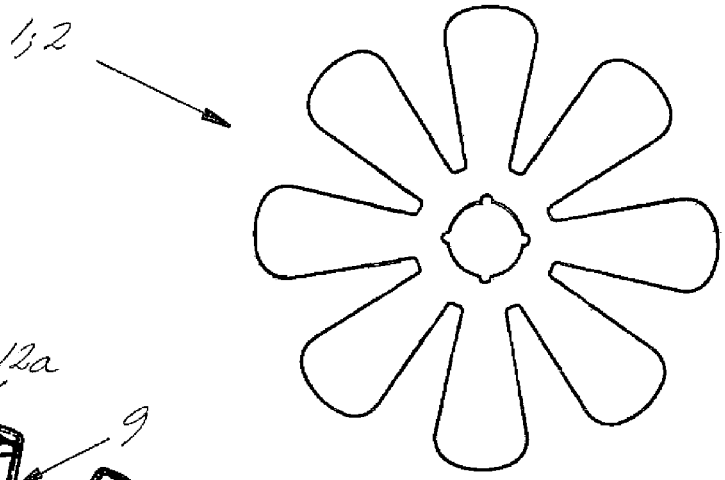
FIG. 4 shows a workpiece for shaping a grinding disc included in the grinding wheel.

The grinding disc 1, 2 is preferably shaped from a generally star-shaped work piece as illustrated in FIG. 4, which can be punched out or cut out from a metal plate. Through plastic machining, such as through a deep drawing procedure, the grinding disc may be finished to the shape illustrated in the other drawings. As shown in the drawing figures, the grinding disc of the preferred embodiment has basically a conical shape with the cone base located at the periphery of the grinding disc and a truncated top at a central region of the grinding disc.

Figure 5:
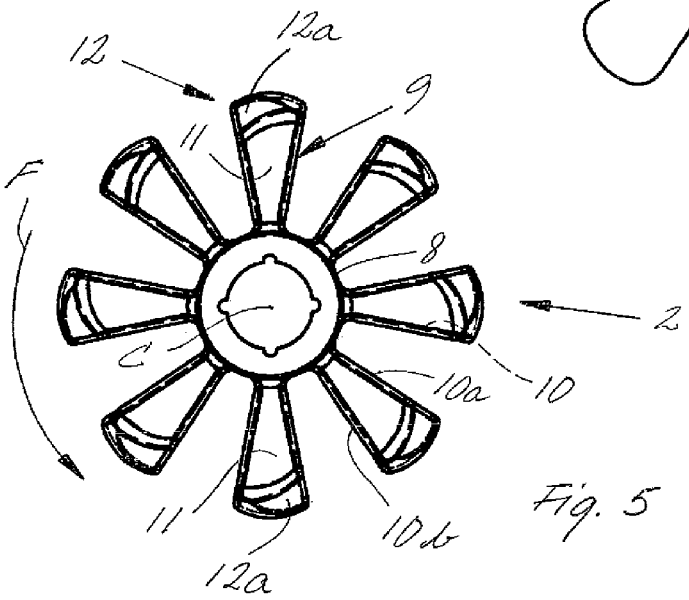
FIG. 5 shows the shaped grinding disc in an end view.

With reference to FIG. 5, the grinding disc 1, 2 comprises a central region or hub section 8 with fingers 9 protruding freely from the hub section 8. The expression "freely protruding" shall be understood in the sense that the fingers are self-supporting and rigid enough not to require any additional support in their outer ends or fingertips. If required, a reinforcement of the finger 9 can be carried out in the form of a flange 10 that is formed during the plastic processing. The flange can be folded out of the plane of rotation from at least one of the longitudinal edges of the finger. The fingers 9 extend radially from the hub section 8 and with an axial component of direction, i.e. at an angle relative to a centre axis of the grinding disc. Furthermore, the fingers 9 are arranged at intervals that are sized for passage of the corresponding fingers of the opposing grinding disc as the discs are mounted onto the shaft. From the hub section towards the periphery of the grinding wheel, the fingers 9 as well as the empty spaces between the fingers, have increasing widths between a leading edge 10*a* and a trailing edge 10*b* of the finger, as seen in the direction of rotation F. For the best utilization of available area of the grinding disc, the widths of the fingers and empty spaces are preferably complementary so that merely a free play which is required for assembly is provided between the fingers.

In effect of the finger's axial component of direction, an essentially V-formed notch V is formed in an axial sectional plane, and defined through the crosswise oriented fingers in intersecting rotational planes in which the fingers comprises an area 11 for treatment of a cutting edge that is inserted in the notch. The area 11 can be arranged for grinding or for polishing, for which purpose the area has a structure and/or a coating which provides a polishing or abrasive effect on the edge. Through coating processes, which are known per se, the area 11 may be coated with diamond, ceramic, hard metal or other hard abrasives, e.g. Such coating may also be applied to extend beyond the area 11, and may for example be extended through the entire length of the finger.

An advantageous and preferred feature of the grinding wheel according to the invention is that the treated edge will be shaped with convex sides as seen in a transverse section of the edge. To this purpose, the fingers of the grinding disc are formed in the longitudinal direction to project a concave area 11 in the plane of rotation, as illustrated in the cut out detail view of FIG. 7.

More particularly, the area 11 is double curved since the finger on which the area 11 is arranged also has a convex curvature along the surfaces of a cone resulting from the basic conical shape of the grinding wheel, as seen in the direction of rotation. This way, the width of the fingers can be fully exploited in the form of a continuous contact with the cutting edge from the finger's leading edge to its trailing edge, as viewed in the direction of rotation.

Another advantageous and preferred feature of the grinding wheel according to the invention is that the notch V, defined by the rotational planes, is formed with an insertion region I in which the width B1 of the notch, as viewed in an axial cross section, is larger at the leading edge of the finger than the corresponding width B2 at the trailing edge of the finger when measured at the same radial distance R1 from the wheel centre C. In this way is avoided the risk that a cutting edge having an unprotected sharp corner will hook onto the grinding wheel upon insertion.

Figure 7:
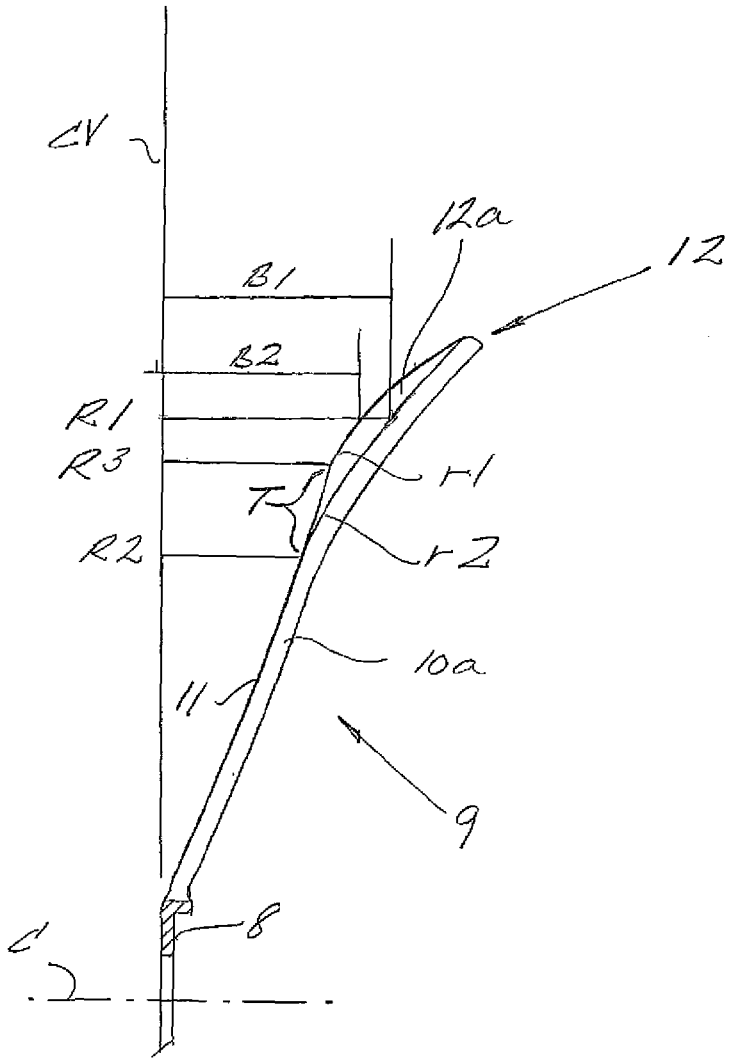
FIG. 7 shows a broken out portion of the grinding disc.

This feature is best understood when looking at FIG. 7, wherein a finger 9 is shown with its leading edge in the direction of rotation facing the viewer. Thus, FIG. 7 illustrates the grinding disc finger extending with the concave area 11 in the rotational plane which runs perpendicular to the drawing plane of FIG. 7. The concave area 11 connects to a convex curvature at the finger tip 12 in a transitional region T. Reference symbols R2 and R3 illustrate that the connection between the concave area 11 and the convex curved finger-tip is located at a shorter radial distance R2 from the grinding wheel centre at the finger's leading edge, than the corresponding radial distance R3 at the finger's trailing edge which is hidden in the drawing. For an unobstructed insertion of the cutting edge from the insertion region to the working area 11, the transition region T preferably has a radius which increases progressively from a radius r1 at the connection to the finger's trailing edge, towards a radius r2, larger than the radius r1, at the connection to the finger's leading edge.

The finger's leading edge, which is the first to meet the cutting edge introduced between the grinding discs in common rotation, is this way angled out of the rotational plane and provides a guiding surface 12*a* directed towards the rotational plane and which gradually moves the substantially tangentially oriented cutting edge towards the middle of the notch, in FIG. 7 represented by the line CV.

Radially inside the transition region T, the width B of the notch V is essentially the same at the fingers leading and trailing edges.

Figure 6:
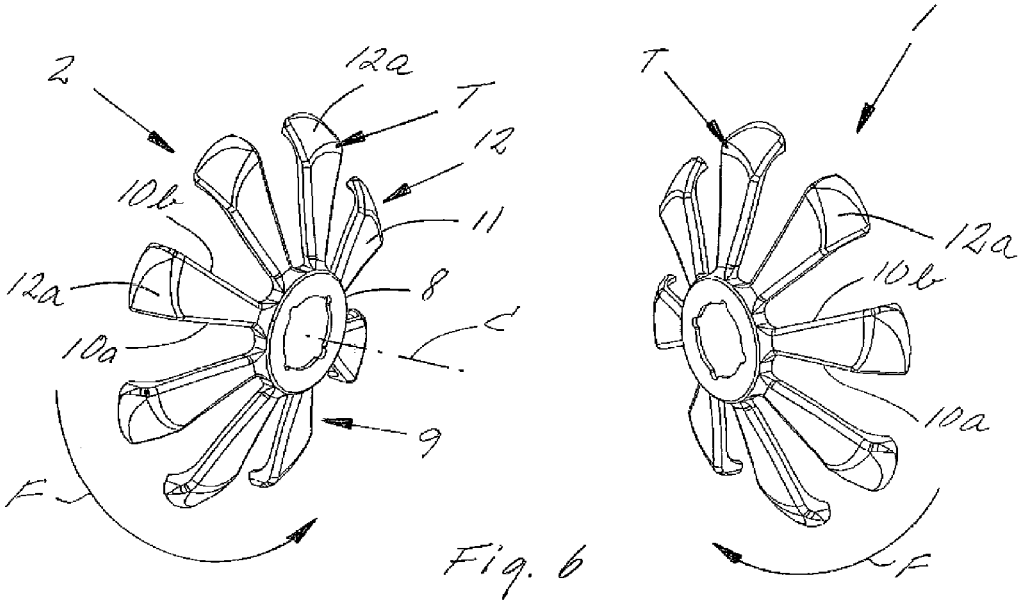
FIG. 6 shows right and left hand grinding discs in a perspective view.

From the above it is realized that the grinding wheel's grinding discs are not symmetrical and interchangeable, and that a right hand and a left hand grinding disc 1, 2 are required for the grinding wheel, as illustrated in FIG. 6.

Feasible Modifications Of The Invention

The complementary width of fingers, the conical basic shape of the grinding discs which provides a continuous contact with the cutting edge, and the grinding discs relative motion against the force of the spring elements all contribute to a maximum utilization of the active and polishing area in a grinding according to the invention.

A person skilled in the art will realize that the grinding discs in the grinding wheel can be produced by means other than through the above mentioned deep drawing procedure, such as by molding, casting, sintering or machining operations. A person skilled in the art will also realize that the grinding discs of the grinding wheel can be made from materials other than metal, such as plastic or ceramic materials, without departing from the inventive idea. Although the grinding discs of the illustrated embodiment are mounted on the shaft using a separate hub, which is subsequently molded on a pre-shaped grinding disc, it is of course possible alternative to cast the grinding disc and the hub in the same material, or in two separate materials by a double-casting process.

Finally, it should be noted that the grinding wheel according to the invention can be used for the treatment of other edges than the cutting edge of a conventional knife blade. Notwithstanding the invention being described in connection with the treatment of knives' edges it is not limited to this application, but it can likewise be used for other purposes such as for grinding/polishing of circular knives and for removing burr on the edges of sheet metal or other sheet materials.

The invention claimed is:

1. A grinding wheel for treatment of a cutting edge, such as a knife's edge, the grinding wheel arranged mountable on a rotatable shaft to be brought in rotation by a driven rotation of the shaft, and comprising two grinding discs (1, 2) opposing each other and arranged movable relative to each other in the shaft's longitudinal direction and pre-tensioned away from one another, each of the grinding discs having a hub section (8) with fingers (9) protruding freely from the hub section at a radial and an axial component of direction, wherein the fingers are arranged at intervals dimensioned for passage of the corresponding fingers of the opposite grinding disc such that the finger's axial components of direction together form an outwardly open, in an axial cross-sectional plane generally V-shaped notch (V) defined by the intersecting rotational planes of the crosswise running fingers, and in which the fingers has an area (11) for treatment of the knife's edge, characterized in that the grinding disc's fingers, as well as the intervals between the fingers, from the hub section towards the periphery of the grinding disc, has increasing width between a leading edge (10*a*) and a trailing edge (10*b*) of the finger as viewed in the direction of rotation, and in that the V-shaped notch in the axial cross section comprises an insertion region (I) in which the notch width (B1) is wider at the finger's leading edge than the corresponding width (B2) at the trailing edge of the finger, when measured at equal radial distances from the grinding wheel centre (C), whereas the width of the notch radially inside said insertion region is the same at the leading and trailing edges of the finger.

2. The grinding wheel according to claim 1, characterized in that in the plane of rotation and radially inside said insertion region to the V-shaped notch, the finger of the grinding disc, has a concave area (11) in the finger's lengthwise direction.

3. The grinding wheel according to claim 2, characterized in that the concave area turns into a convex curvature at the finger tip (12).

4. The grinding wheel according to claim 2, characterized in that the concave area (11) of the grinding disc's finger (9) is double-curved as a result of the grinding disc (1,2) beings shaped at manufacture to have a conical basic shape, whereby the finger, in addition to the concave shape in the length direction of the finger, also has a convex curvature lying on the cone's mantle surface, as seen in the direction of rotation.

5. The grinding wheel according to claim 3, characterized in that the connection (T) between the concave area (11) and the curved, convex finger-tip (12) is located at a shorter radial distance from the grinding disc centre (C) at the fingers leading edge (10*a*) than at its trailing edge (10*b*).

6. The grinding wheel according to claim 5, characterized in that the curved, convex finger tip (12) has a radius (r2) at the connection to the concave area (11) at the fingers leading edge (10*a*), which radius (r2) is greater than a radius (r1) at the connection at the trailing edge of the finger (10*b*).

7. The grinding wheel according to claim 1, characterized in that the grinding disc is shaped by deep drawing of a singular metal work piece.

8. The grinding wheel according to claim 7, characterized in that the grinding disc's finger has a longitudinal reinforcement (10) in at least one edge of the finger, preferably a flange that by deep drawing is folded to extend out of the plane of rotation.

9. The grinding wheel according to claim 1, characterized by an abrasive or polishing coating applied to the grinding disc fingers.

10. The grinding wheel according to claim 1, characterized in that the grinding disc has a hub (3,4) shaped for receiving a spring element (6).

11. The grinding wheel according to claim 10, characterized in that the grinding disc has a hub which is molded onto the grinding disc.

12. The grinding wheel according to claim 3, characterized in that the concave area (11) of the grinding disc's finger (9) is double-curved as a result of the grinding disc (1,2) beings shaped at manufacture to have a conical basic shape, whereby the finger, in addition to the concave shape in the length direction of the finger, also has a convex curvature lying on the cone's mantle surface, as seen in the direction of rotation.

13. The grinding wheel according to claim 4, characterized in that the connection (T) between the concave area (11) and the curved, convex finger-tip (12) is located at a shorter radial distance from the grinding disc centre (C) at the fingers leading edge (10*a*) than at its trailing edge (10*b*).

* * * * *